US006038972A

United States Patent [19]

Delwiche et al.

[11] Patent Number: 6,038,972

[45] Date of Patent: Mar. 21, 2000

[54] QUICK CHANGE SYSTEM FOR A PRESS

[75] Inventors: Christopher Delwiche; Joseph Bero; Gregory Ginnow, all of Green Bay, Wis.

[73] Assignee: Paper Converting Machine Company, Green Bay, Wis.

[21] Appl. No.: 09/222,210

[22] Filed: Dec. 29, 1998

[51] Int. Cl.[7] ..... B41F 5/00

[52] U.S. Cl. ..... 101/216; 101/477

[58] Field of Search ..... 101/212, 216, 101/477, 486, 485, 153, 174, 141, 142

[56] References Cited

U.S. PATENT DOCUMENTS

| | | | |
|---|---|---|---|
| 4,199,289 | 4/1980 | Segbert | 414/347 |
| 4,462,311 | 7/1984 | Armelin | 101/143 |
| 5,010,813 | 4/1991 | Buffo | 101/178 |
| 5,060,569 | 10/1991 | Gladow | 101/216 |
| 5,549,044 | 8/1996 | Achelpohl | 101/216 |
| 5,570,633 | 11/1996 | Schultz | 101/182 |
| 5,715,749 | 2/1998 | Miller | 101/216 |

FOREIGN PATENT DOCUMENTS

| | | |
|---|---|---|
| 032445A2 | 1/1989 | European Pat. Off. . |
| 0498012A1 | 2/1991 | European Pat. Off. . |
| 0464309B1 | 3/1991 | European Pat. Off. . |

*Primary Examiner*—Christopher A. Bennett

[57] ABSTRACT

A robotic apparatus for a printing press transports components between the press and a staging or make-ready area so that components can be prepared for a new press run off-line from the press. The robotic apparatus includes a pair of lifting assemblies which are movable horizontally between the press and a support frame in the make-ready area. Each of the lifting assemblies includes a vertically movable lift mechanism, and each lift mechanism includes a plurality of lifting cups for engaging the ends of the components of the press which are to moved. The lifting cups can be operated independently, so that desired components can be moved from any printing deck to any position on the support frame. The press components which can be moved include a plate cylinder and a carriage assembly. The carriage assembly includes a frame, an anilox roll assembly mounted in the frame, and an ink container mounted on the frame.

14 Claims, 10 Drawing Sheets

QUICK CHANGE SYSTEM FOR A PRESS

BACKGROUND

This invention relates to printing presses, and, more particularly, to a quick change system for a press such as a flexographic press.

The multicolor flexographic printing process requires the use of components specific to each job. These components consist of the following:

1. plate cylinders, the diameter of which corresponds to the repeat dimensions of the image being printed;
2. anilox rolls, whose cell variables depend upon the characteristics of the ink and image being printed;
3. the inks and their containers.

All of these components need to be exchangeable. There may be situations where an unfavorable anilox roll will be changed during a run. A plate cylinder change may be the only component change if the same ink is going to be used on the next job. Perhaps the ink mixture is not producing the desired print quality and needs to be replaced. A common changeover will require all components to be exchanged in preparation for a completely new print run.

A typical wide web central impression printing press will be provided with some means of operator assistance for component exchange. Operator assistance is required since the plate rolls can weigh up to 800 pounds or more and the anilox rolls can weight in the range of 500 pounds. Operator assistance includes:

1. Manual hoist systems. This type of system utilizes I-beams running parallel to the center line of the press. Chain fall hoists, which travel along the I-beams, are equipped with adapters which attach to the journals of the plate cylinders and anilox rolls. With the adapters in place, the components can be lifted from the color deck of the press and placed in a roll cart. Likewise, new (made ready) components are transported back to the color deck.
2. Synchronized hoist systems. This type of system is similar in function to a manual hoist system except for the synchronized motion of the chain falls. It is easier to use and can provide a quicker changeover than the manual type system.
3. Robotic systems. A typical system travels across the press in the same fashion as the hoist systems. A cylinder or roll location in the press, location in the cart, and path between the two are programmed. A robotic system can be quicker and safer to use than the hoist type systems.

Hoist and robotic systems have proved useful in daily pressroom operations. Still, problems exist. Those systems are not capable of changing doctor holders or ink containers. For example, U.S. Pat. No. 5,010,813 describes a robot that can replace a single cylinder. Furthermore, plate and anilox rolls need to be cleaned before they can be removed from the press. Changeover on this size of machine cannot be obtained in a quick enough fashion with the common hoist or robotic system.

In the past a typical press run was longer than it is today. A six-hour run was followed by a two-hour changeover. This example produced a 25 percent downtime. Shorter print runs are common today. A more typical run of two hours is still followed by a two-hour changeover. Thus, a 50 percent downtime factor results. Downtime does not produce revenue.

Other printing machines such as a narrow web press and gravure press condense the changeover time by separate methods. Both types of machines have design compromises. The narrow web industry has adopted the philosophy of using cartridges that contain the inking unit and print cylinder. However, these cartridges are small (under 100 pounds and maximum width of 20 inches) and can be handled by the operator, unlike the wide web application. For example, U.S. Pat. No. 5,060,569 describes a cartridge that can be slid into position on a pair of rails by the operator. Furthermore, the cartridge in that patent is located in the press by using the frame of the cartridge instead of the printing cylinder.

A gravure press also incorporates a cart system to decrease the changeover time. A gravure cart is wheeled into place and is always on the floor. The cart is larger, but the gravure application has the advantage of space because the process does not require printing on a central impression drum. A gravure press like most narrow web presses uses an in-line configuration that does not print quality (color-to-color register within 0.003 inch) images on extensible webs. These cartridges in both cases also have the problem of not being able to replace the print cylinder without replacing the cartridges

SUMMARY OF THE INVENTION

The goal of this invention is to create a wide web printing press of the type described above that can obtain a significant decrease in changeover time. Fifteen minutes or less changeovers would be a proper goal with today's shorter runs.

To provide a system that can reduce downtime further than what is available today requires a changeover process study. The purpose of the changeover analysis is to change as many internal tasks (tasks that take place during changeover) as possible to external tasks (tasks that occur when the machine is running). This change in method requires changes in the design of the printing press. These changes must support the following criteria:

1. Changeover operations must be robotic, rather than operator paced, in order to guarantee changeover time requirements. When attempting to accomplish 15 minute changeovers, the variable human factors become too great. Although not directly related to changeover, robotics can also provide for a safer working environment and less change of component damage during changeover. Programmed exchange moves need to be entered into the robot controller prior to the changeover process.
2. Clean-up of any components cannot be done on the press. This is a time-consuming task which holds up all tasks following it.
3. A new design must be versatile. It must provide for a quick complete changeover, yet still be able to provide partial (one component at a time) exchanges when necessary.
4. The design must maintain current print quality in the finished product.

The invention provides such a design, based upon the changeover study and the criteria listed. This design consists of three major components:

1. Color Deck Carriage: A color deck carriage consists of a set of frames housing the anilox roll and the support structure for the ink handling system for a single color deck. The ink handling system will include the doctor holder, ink container, pump, viscosity control system, drip containment pan, and required hoses and piping. The anilox roll is removably positioned in the carriage frame by a set of journal caps. This carriage is independent of the press itself. It provides a totally integrated ink delivery system. It is transported to and from the color deck by a robotic system. It could also be transported by other more manual means such as a hoist system.

2. Staging Structure: Each printing deck requires two color deck carriages. One is staged within the press during a run. The second is located on a staging structure in a make-ready state. A staging area, facilitated by the staging structure, provides the means to prepare the carriage for the next press run. All clean-up, roll exchanges, and next job set-up are accomplished while the press is running a job. This allows internal changeover tasks to be converted to external tasks as changeover process study requires.

3. Robotic System: The color deck carriage can be transported in a number of ways. The most efficient method would involve the use of a robotic system. The robot to be described will complement the function of the previously described color deck carriage. It is also versatile enough to allow for partial exchanges which would not necessarily involve the carriage. It improves changeover tasks over standard prior art robots by transporting all of the components for an entire deck, thereby eliminating the need for multiple exchanges during the changeover time. The robot is capable of motion in three directions or axes:

1. motion between the press and the staging structure;
2. motion into and out of the press section or into and out of the staging structure, essentially a horizontal motion;
3. motion in the vertical axis.

The robot functions as a three-point "pick and choose" system. The robot transports components by three lifting cups on each side of the press. These cylinder-actuated cups will be either extended or retracted. When all of the cups are fully extended, a complete color deck changeover can be made. One lifting point will pick up the plate cylinder journals, the next will pick up the anilox roll journals, and the third will pick up the color deck carriage. The lifting cups can also lift the plate roll alone, the anilox roll alone, the plate and anilox roll together, or the anilox roll with carriage.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
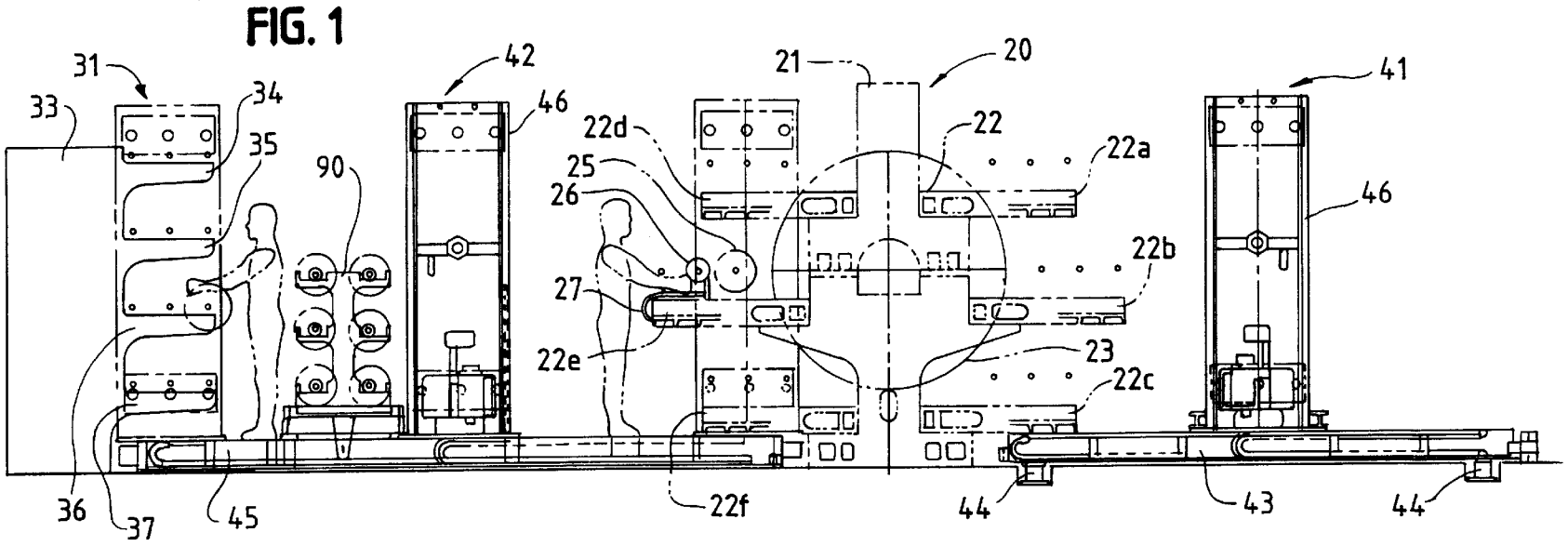
FIG. 1 is side elevational view of a flexographic printing press and a robotic assembly which is formed in accordance with the invention.

Referring to FIG. 1, a conventional flexographic press 20 includes a pair of side frames 21 which support a plurality of color decks 22. In the particular embodiment illustrated, the press includes six color decks 22*a*–22*f*. A central impression cylinder 23 is rotatably mounted on the frames.

Each of the color decks supports a plate cylinder or roll 25, an anilox roll 26, and a color deck carriage 27. The carriage 27 includes the ink system for the press.

The plate cylinders and the anilox rolls are shown in their racked-out, non-operating positions in FIG. 1. When the press is operating, the plate cylinders are adjacent the surface of the central impression cylinder, and the anilox rolls contact the plate cylinders. Ink is thereby transferred to the plate cylinders, and images are transferred to a web which rotates with the central impression cylinder.

As will be explained more fully hereinafter, the plate cylinders and anilox rolls are advantageously mounted on the color decks so that each plate cylinder and each anilox roll can be removed from the color deck independently of the color deck carriage 27. Alternatively, each anilox roll can be removed from the color deck with the carriage, or all three components can be removed simultaneously.

First and second staging areas or make ready areas 30 and 31 (FIGS. 1–5) are located adjacent the two sides of the press for supporting the components of the color decks for the next run of the press. The components for the color decks 22*a*–22*c* are located in the staging area 30, and the components for the color decks 22*d*–22*f* are located in the staging area 31.

Figure 6:
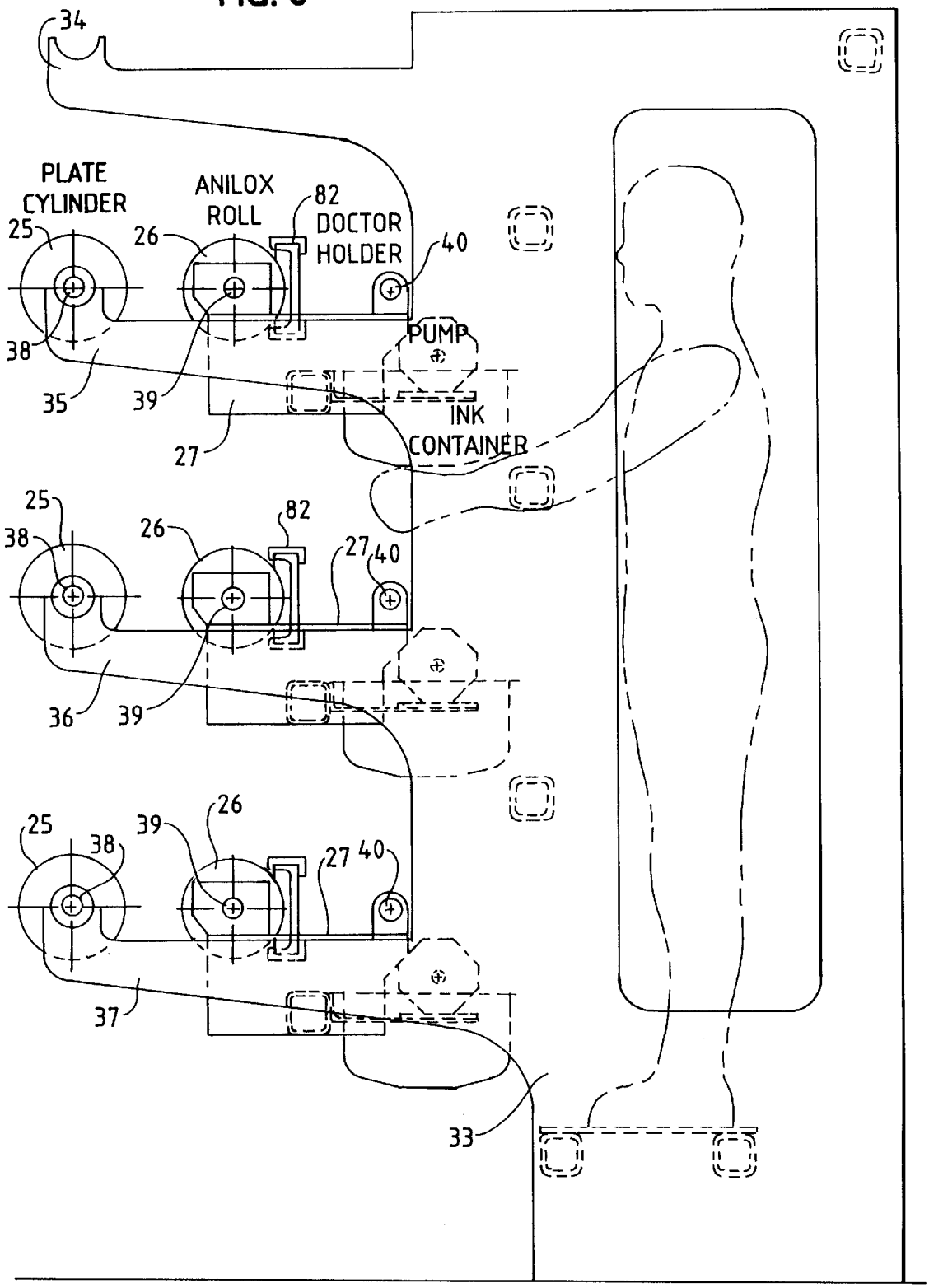
FIG. 6 is a side view of one of the staging areas.

Each staging area includes a pair of support frames 33, and each support frame includes four support decks 34–37. Referring to FIG. 6, each of the support decks 35–37 supports a plate cylinder 25, an anilox roll 26, and color deck carriage 27 for one of the color decks of the press. The upper support deck 34 is empty and provides a location to which the components of one of the color decks can be moved during changeover. Each plate cylinder includes a pair of laterally extending journals 38 which are supported by the support frame 33. Similarly, the anilox rolls include journals 39, and the color deck carriages include dead journals or non-rotating shafts 40 which are also supported by the support frames 33. The deck components for the next press run are not shown in FIGS. 1 and 2 for clarity of illustration.

The components of the color decks are transported between the color decks 22 and the staging areas by a pair of robot assemblies 41 and 42. The robot 41 moves between the color decks 22*a*–22*c* and the staging area 30. The robot 42 moves between the color decks 22*d*–22*f* and the staging area 31.

The robot 41 includes horizontal rails 43 for movement in one horizontal axis, and the rails 43 are slidably mounted on perpendicular rails 44 so that the robot can move in a second horizontal axis. The robot 42 moves in only one horizontal axis on rails 45, but the robot 42 could be mounted for movement in another horizontal axis if desired.

Rails 43–45 are purchased linear motion modules, such as STAR MKR 25-145 or 25-110. Each of the rails 43–45 includes a sliding base 43*a*, 44*a*, 45*a* (FIGS. 4 and 5) respectively, which is supported by linear motion bearing blocks traveling upon a linear rail and which is driven by a toothed belt which is clamped to the sliding base. The sliding base 43*a* and 45*a* on the rails 43 and 45 provide a mounting platform for the vertically extending modules 46 of the robots 41 and 42. The sliding bases 44*a* on the rails 44 provide a mounting platform for the rails 43.

Each of the robots includes a pair of modules 46, and each module is bolted to one of the sliding bases 43*a* and 45*a* which are slidably supported on the rails 43 and 45. Referring to FIGS. 7–10, each of the modules includes a vertically extending frame 47 and a pick-up carriage 48 which is movable vertically along the frame. The pick-up carriage is guided by two sets of linear motion bearing blocks 49 (FIG. 10) traveling upon a pair of vertical rails 50. The bearing blocks and linear rails provide smooth operation and high load carrying capacity. The pick up carriage is driven through a ball screw assembly consisting of a driven ball screw 51, which is secured to the vertical support structure with a fixed pillow block bearing 52 (FIG. 9) at the bottom and a floating pillow block bearing 53 at the top, and a threaded nut housing 54 attached to the pick up carriage. The ball screw is driven by a motor 55 such as an Indramat DDS servo motor.

Figures 7, 8, 9:
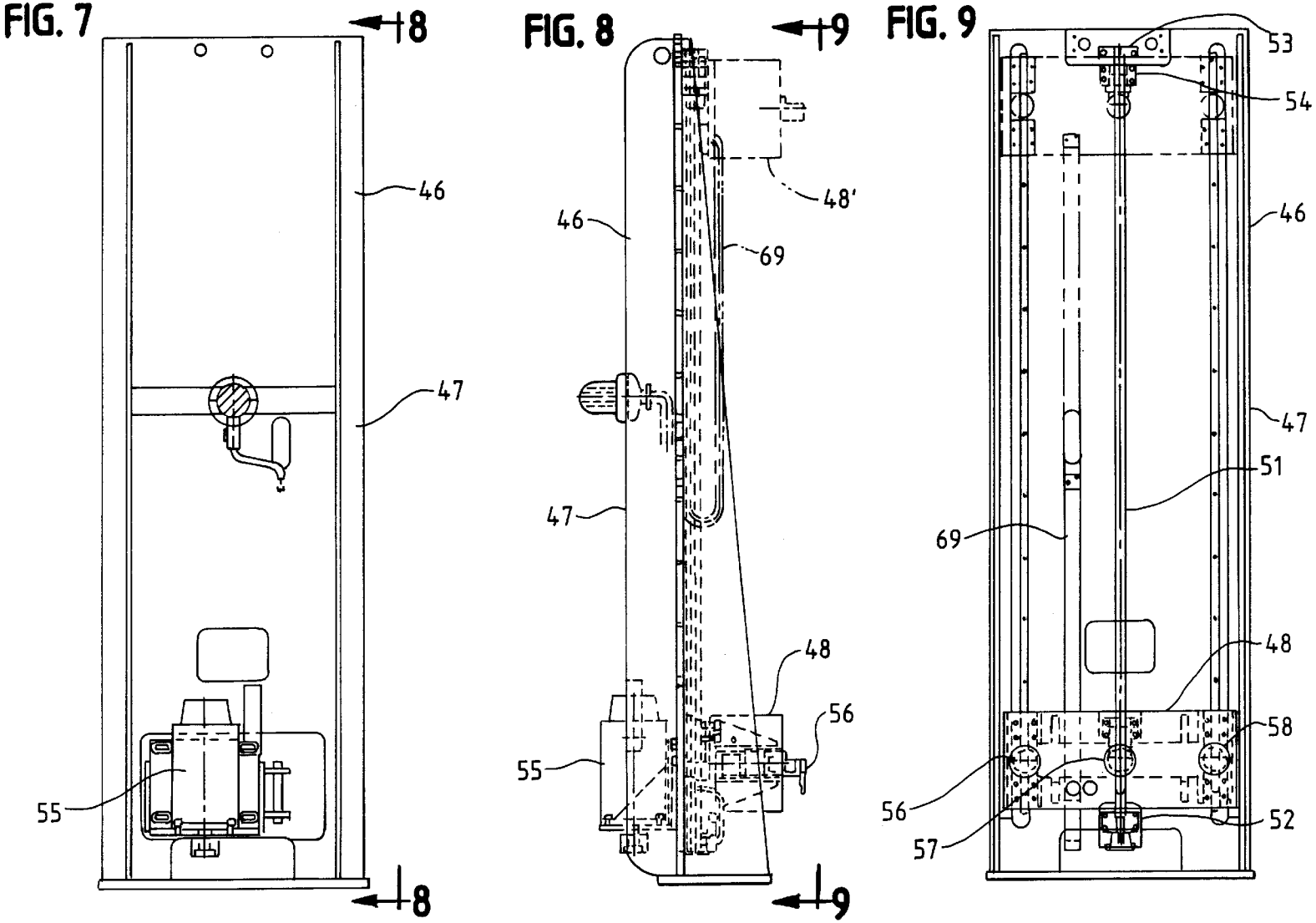
FIG. 7 is an enlarged side elevational view of the vertical motion structure of one of the robots.
FIG. 8 is a view taken along the line 8—8 of FIG. 7.
FIG. 9 is a view taken along the line 9—9 of FIG. 8.
Figure 10:
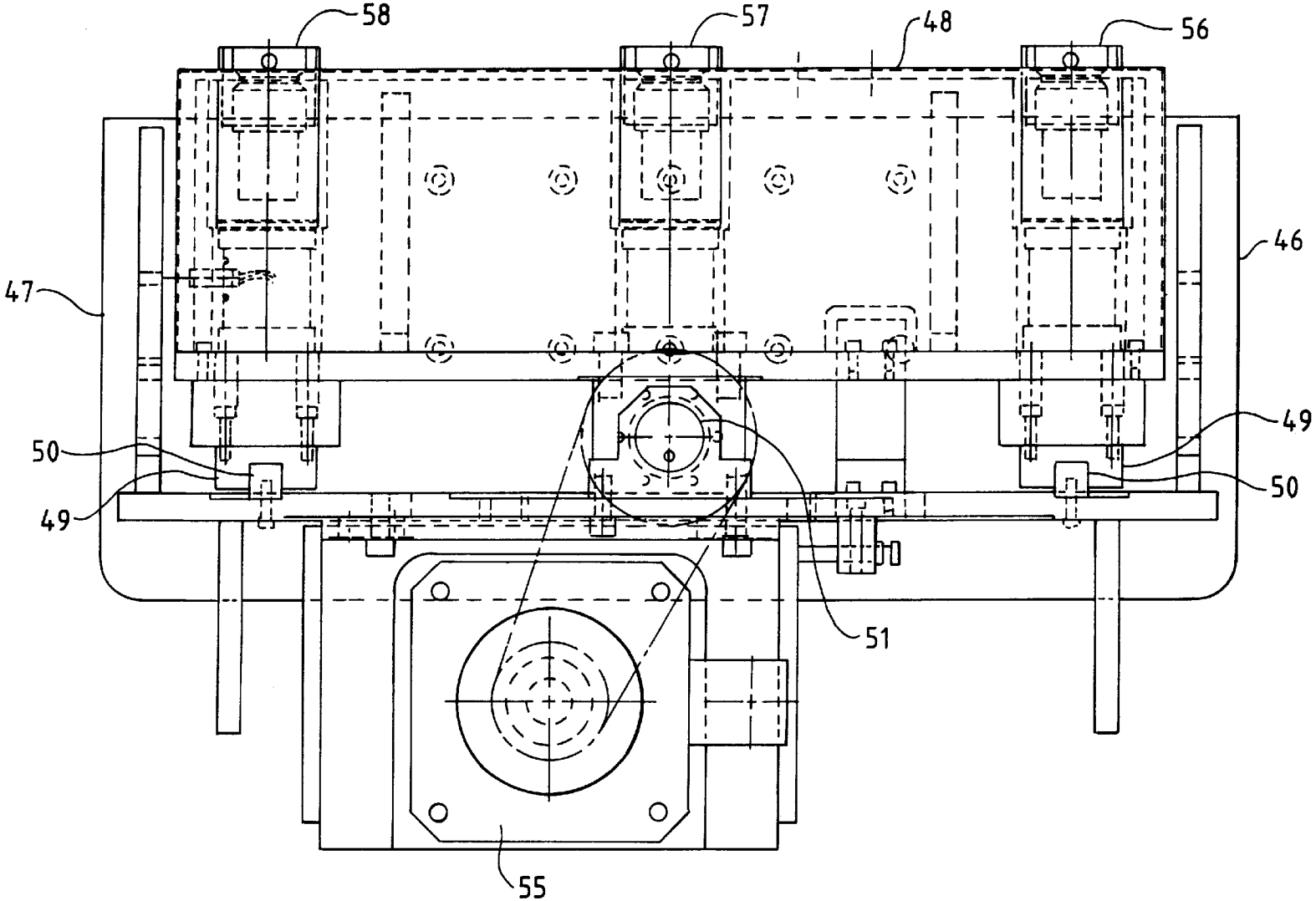
FIG. 10 is an enlarged top plan view of FIG. 7.

The lower position of the pick-up carriage is shown in solid outline in FIG. 8, and the upper position is shown in dotted outline at 48'. Three extendible and retractable lifting cups 56, 57, and 58 are mounted on the pick-up carriage.

Figure 13:
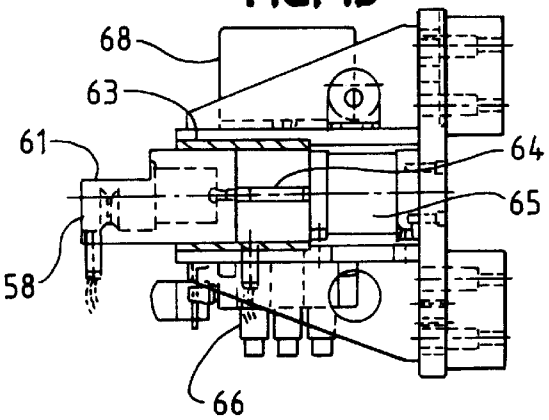
FIG. 13 is a view taken along the line 13—13 of FIG. 11.
Figure 11:
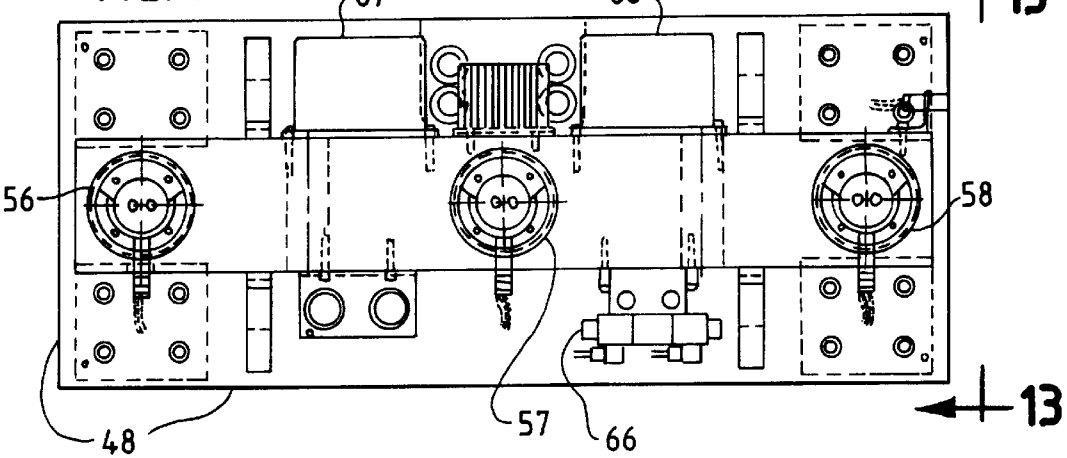
FIG. 11 is an enlarged view of a portion of FIG. 9 showing the lifting pick-up carriage.
Figure 12:
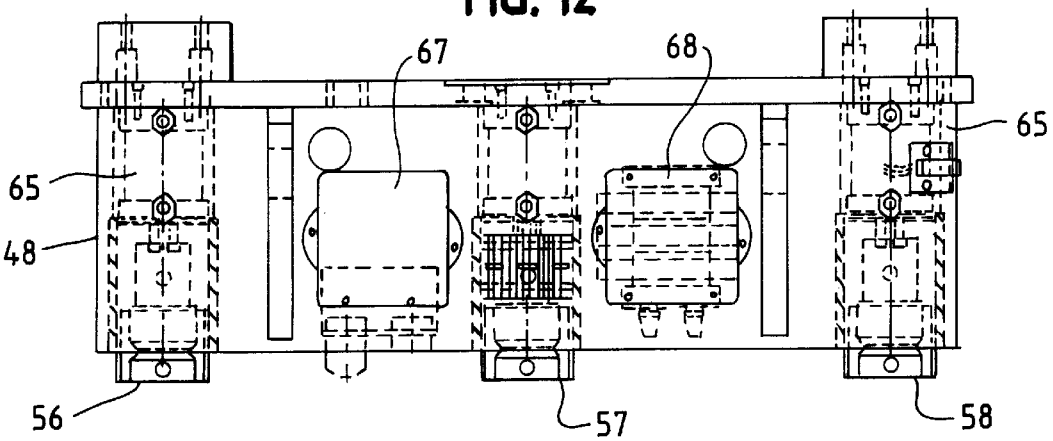
FIG. 12 is a top view of the pick-up carriage of FIG. 11.

Referring to FIGS. 11–13, each of the lifting cups 56–58 includes a cylindrical rear end 60 (FIG. 13) and a semi-cylindrical front end 61. The cylindrical rear end is slidably mounted in a cylinder 63, and the lifting cup is reciprocated by a ram 64 of a pneumatic cylinder 65. The lifting cup 58 is shown in its extended position in FIG. 13, and all of the lifting cups are shown in their retracted positions in FIG. 12. Each of the pneumatic cylinders 65 can be operated independently so that each of the lifting cups can be extended or retracted independently of the other lifting cups. Air for the pneumatic cylinders is controlled by valve bank 66, distributed control input block 67, and distributed control output block 68. Air and electrical power are supplied to the movable pick-up carriage 48 by cable track 69 (FIG. 8).

The robots 41 and 42 can function as a three-point "pick and choose" system. Each robot has the capability to transport components by the three lifting cups 56–58 on each side of the press. These cylinder-actuated cups will be either extended or retracted. When all of the cups are fully extended, a complete color deck changeover can be made. One pair of lifting cups will pick up the plate cylinder journals 38 (FIG. 6), another pair of cups will pick the anilox roll journals 39, and the third pair of cups will pick up the journals 40 of the carriage 27.

Figure 17:
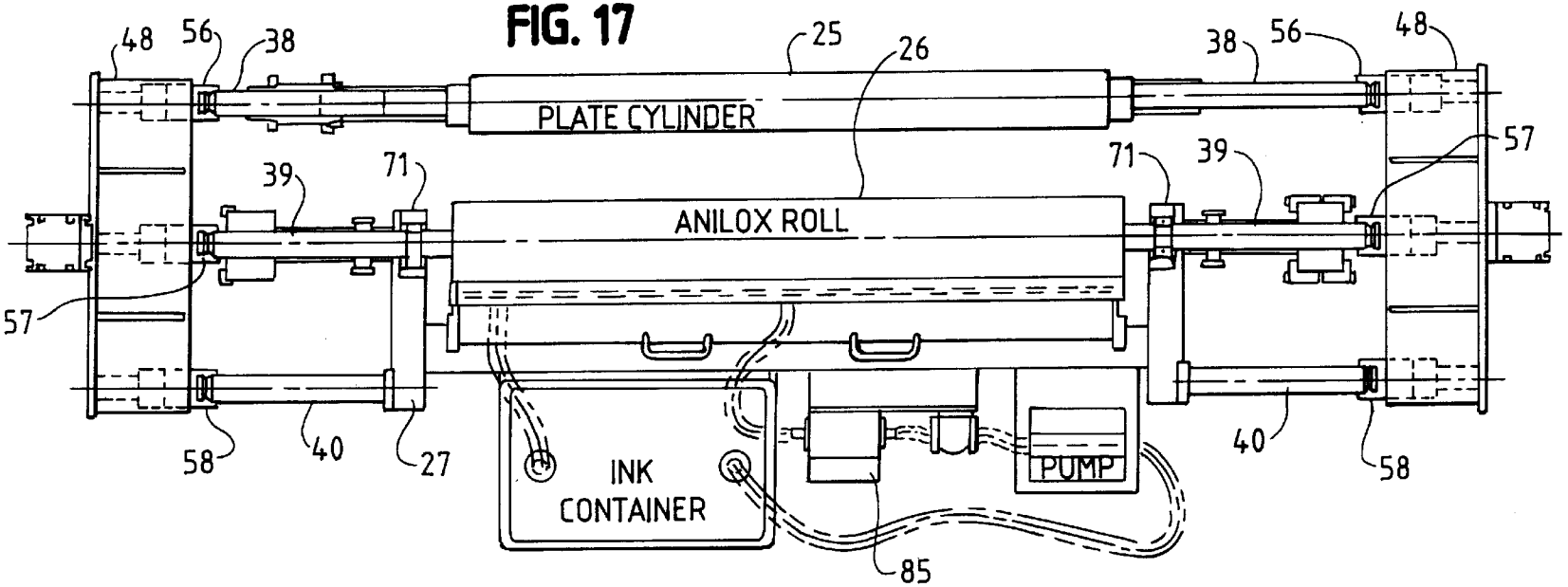
FIG. 17 is a top view of the color deck carriage supported by the pick-up carriages of the robot.

FIG. 17 illustrates the two pick-up carriages 48 of one of the robots lifting the plate cylinder 25, anilox roll 26 and color deck carriage 27 of one of the color decks of the press. The ends of the journals 38–40 are supported by the lifting cups 56–58. The anilox roll is rotatably mounted on, and removably connected to, the color deck carriage by conventional journals caps 71. The color deck carriage is supported by both the anilox journals 39 and the dead journals 40.

Although the preferred embodiment of the lifting carriage includes three lifting cups, the lifting carriage could have only two lifting cups.

The plate cylinder journals 38 and anilox roll journals 39 are rotatably and removably mounted on the frame of the flexographic press in the conventional manner by bearing caps or journal caps. The non-rotating journals 40 of the color deck carriages are not supported in the color deck of the press. It is very important to the design that location of the carriage is based only on the anilox roll bearing caps. The carriage is supported by the frame of the press, but essentially "floats" so that any inconsistencies of manufacturing of the carriage do not result in misalignment within the press.

The plate rolls and anilox rolls are precisely located in the color deck of the press by the bearing caps or journal caps. The carriage 27, which is tied to the anilox roll, cannot bottom itself out prior to the anilox bottoming out within its bearing cap. This design will maintain the precision of the deck and the quality of the print over the lift of the machine.

The components of a color deck are removed from the press by positioning the lifting cups of the pick-up carriage below the journals, opening the journal caps which hold the journals on the frame of the press, and then raising the pick-up carriages. The semi-cylindrical ends of the lifting cups capture the ends of the journals and lift the components out of the journal caps and out of the press. The robot is then moved to transport the components to the make-ready area.

The robot can exchange all components required for a complete changeover. It can also select the plate roll, the anilox roll, the plate and anilox rolls, or the anilox roll with carriage individually. The lifting cups for the components which will be changed are extended so that the lifting cups engage the journals of those components. The other lifting cups are retracted so that they do not engage the journals of the components which will not be changed.

Figure 14:
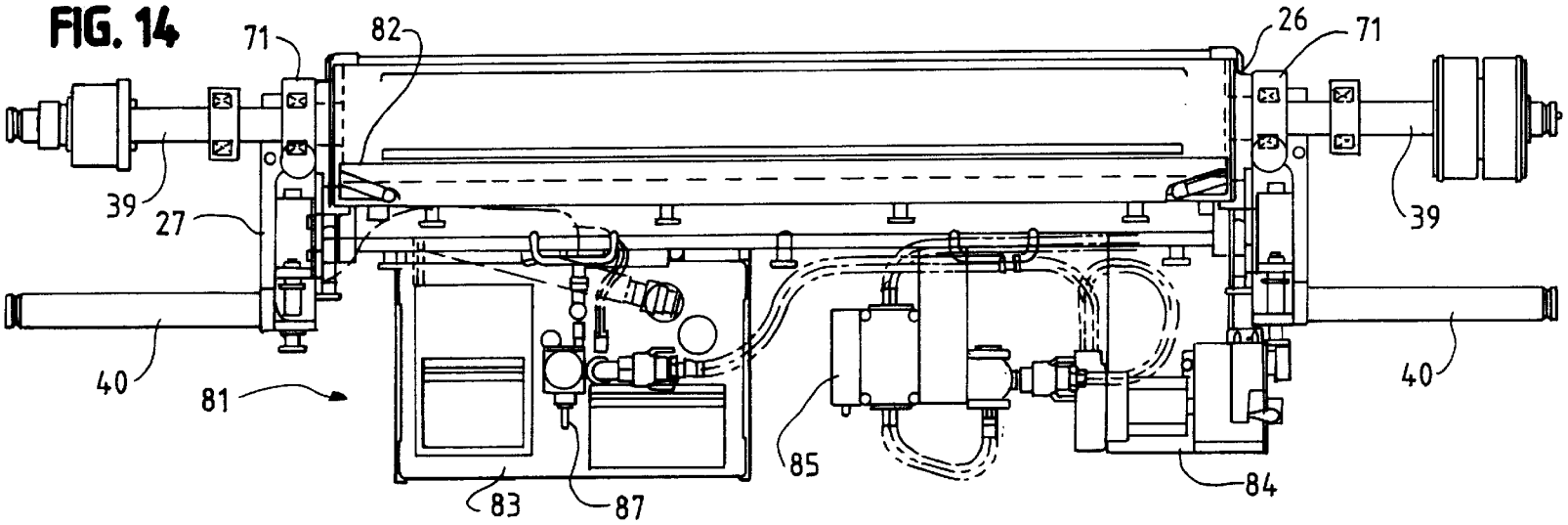
FIG. 14 is a top view of the color deck carriage assembly of one of the color decks of the flexographic press.

Referring to FIG. 14, the journals 39 of the anilox roll 26 are removably attached to the color deck carriage 27 by journal caps 71. If the anilox roll 26 but not the carriage 27 is to be changed, the journal caps 71 are opened so that the anilox roll can be lifted out of the carriage 27.

Each robot is driven horizontally by an electric motor 72 (FIGS. 4 and 5) through a drive such as an Indramat servo drive and motor controlled by a motion control system located in a control cabinet 74 near the press section. In each case the motor drives through a gear box to achieve a torque reduction between the motor and the load. Motors 72 are used to drive the sliding bases 43*a* and 45*a*, and each motor moves the associated robot in a first horizontal direction into and out of the press. A torque tube 75 or cross drive links the two vertical modules 46 of each robot so that they travel together horizontally. Motor 73 is used to drive the sliding bases 42*a* and moves robot 41 in the second horizontal direction between the press and the staging structure 30. Again, a torque tube 76 or similar device links each module of the robot so that they travel together. Depending upon the size of the load, the torque tube may not be necessary.

The motion control system can be a motion controller such as a Giddings & Lewis PIC 945 and provides the commands to each motor/drive combination. The commands to each drive will enable the robot to move the deck components in a programmed path that will avoid obstacles. The operator of the system will select the source location and the destination of the component or components that need to be moved. The motion control system will calculate and control the location of each axis throughout the entire motion profile.

Figure 15:
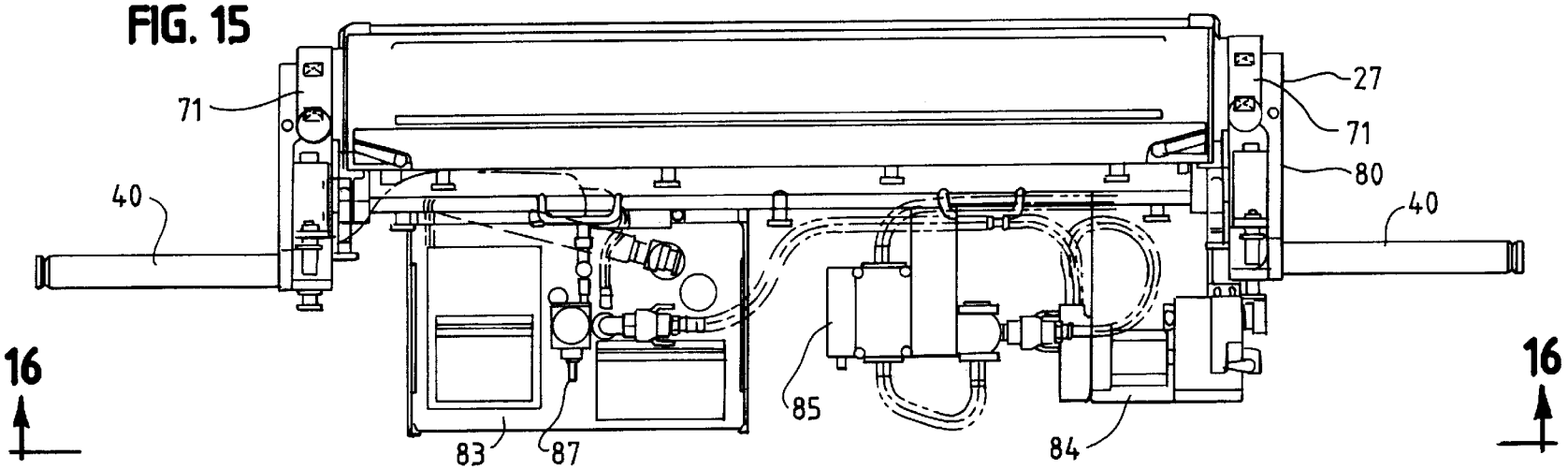
FIG. 15 is a view similar to FIG. 14 with the anilox roll removed from the color deck carriage.
Figure 16:
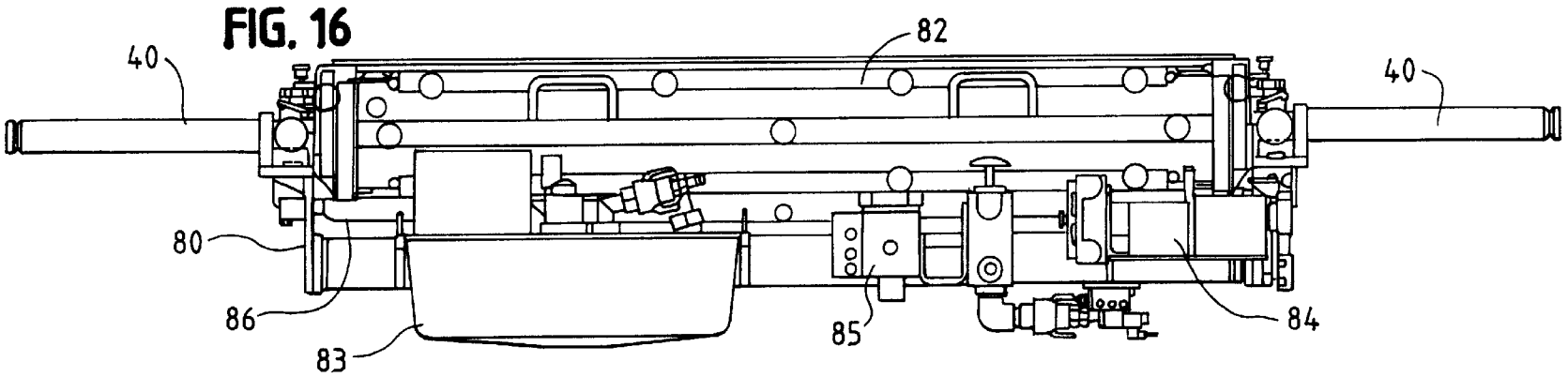
FIG. 16 is view taken along the line 16—16 of FIG. 15.

Referring to FIGS. 14–16, each of the color deck carriages 27 includes a frame 80 for supporting an anilox roll 26 and the ink handling system 81 for a single color deck. The ink handling system 81 includes a doctor blade assembly 82, an ink container 83, a pump 84, a viscosity control system 85, a drip containment pan 86, and required hoses and piping. Such components are well known, and a detailed description is unnecessary.

The carriage 27 is independent of the press and provides a totally integrated ink delivery system. The entire carriage, including the anilox roll 26, is transported to and from the color deck by the robot. The carriage could also be transported by other means, such as a hoist system or other manual means.

The size of ink containers vary. A typical five gallon container 83 is illustrated. The container is shallow enough so that it does not interfere with obstructions on the deck. The ink container in this design travels with the carriage, which allows the hoses to and from the container to be relatively short. The length of hose is critical in preventing twists and kinks which cause pressure disturbance in ink flow and ultimately leaks in the system. An air driven stirrer 87 can also be included with the container to insure ink circulation.

An alternative to the described ink container is a typical pail which is of a depth that would prevent the racking in movement of the carriage. This size container would collide with spacers or between color dryers. Provisions can be designed into a carriage to alleviate this problem. As the robot (see later description) transports the carriage to the press, via a programmed path, it will make a final downward movement. As it lowers the carriage, the ink container disengages from the carriage by bottoming itself out on a catch pin. After this disengagement the robot continues its downward movement and places the plate and anilox journals into their respective journal caps.

The staging provides the means to prepare plate cylinders, anilox rolls, and color deck carriages for the next press run. Each staging area can include a conventional Sunday drive system, permitting anilox roll wash-up as well as ink-up prior to the next run. All clean-up, roll exchanges, and next job set up are accomplished while the press is running a job. This allows internal changeover tasks to be converted to external tasks as changeover process study requires.

Converting many of the internal changeover tasks to external tasks substantially reduces machine downtime. The clean-up and make-ready tasks have been converted to external operations. These tasks still need to be accomplished before a typical two hour or less run is completed. The following is a description of the system which will perform these external operations.

Figure 2:
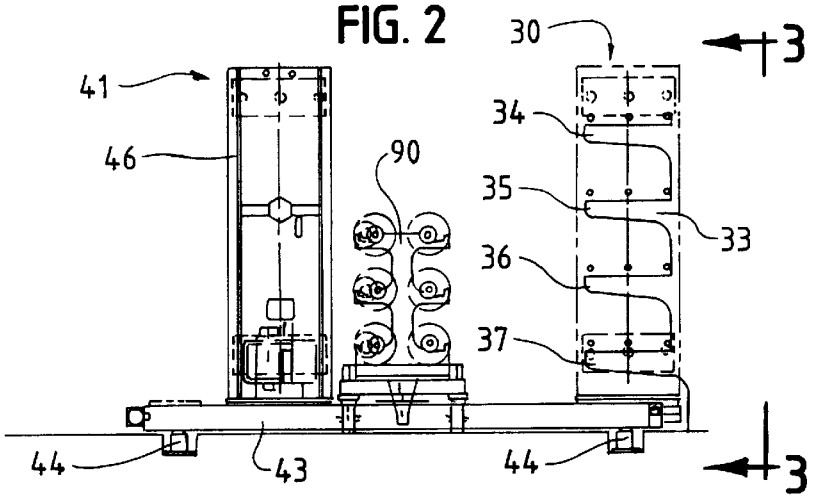
FIG. 2 is a side elevational view of the right hand robot of FIG. 1 and a second staging area.
Figure 3:
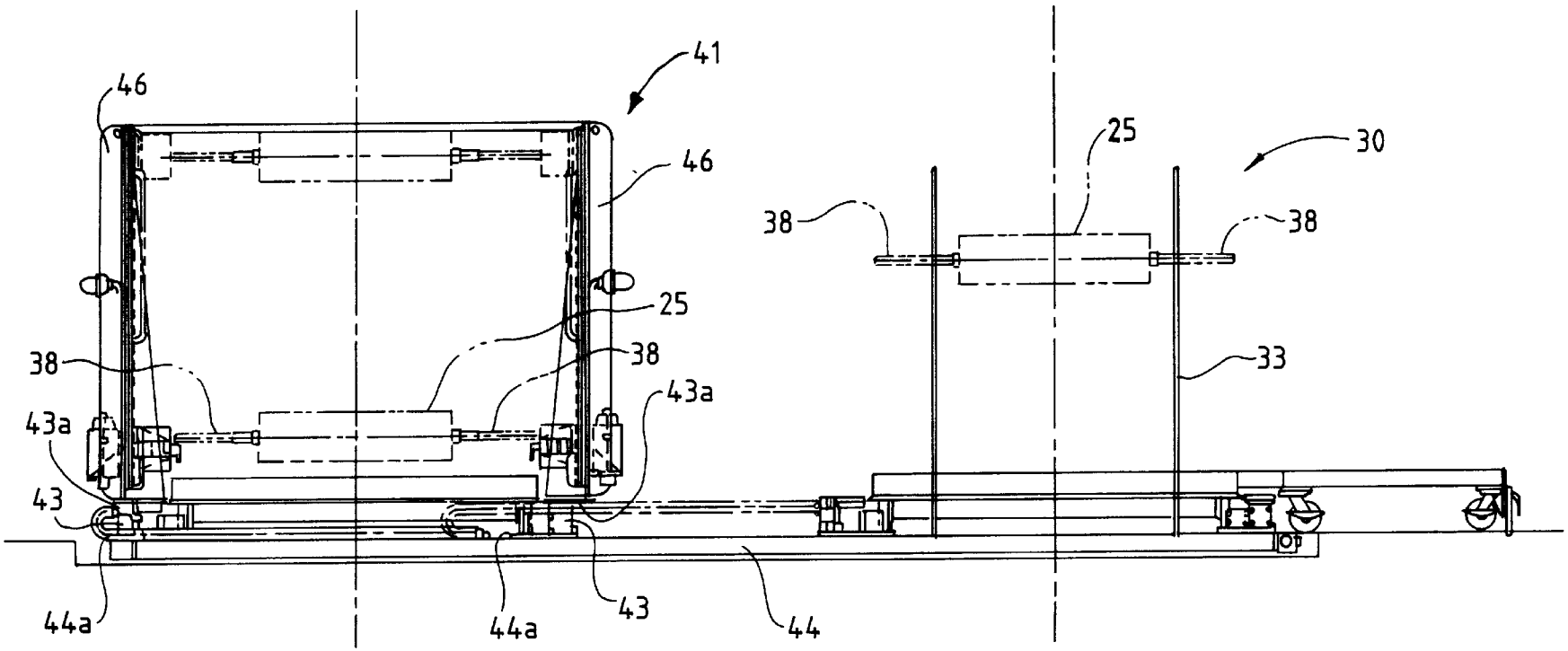
FIG. 3 is and end view taken along the line 3—3 of FIG. 2.
Figure 4:
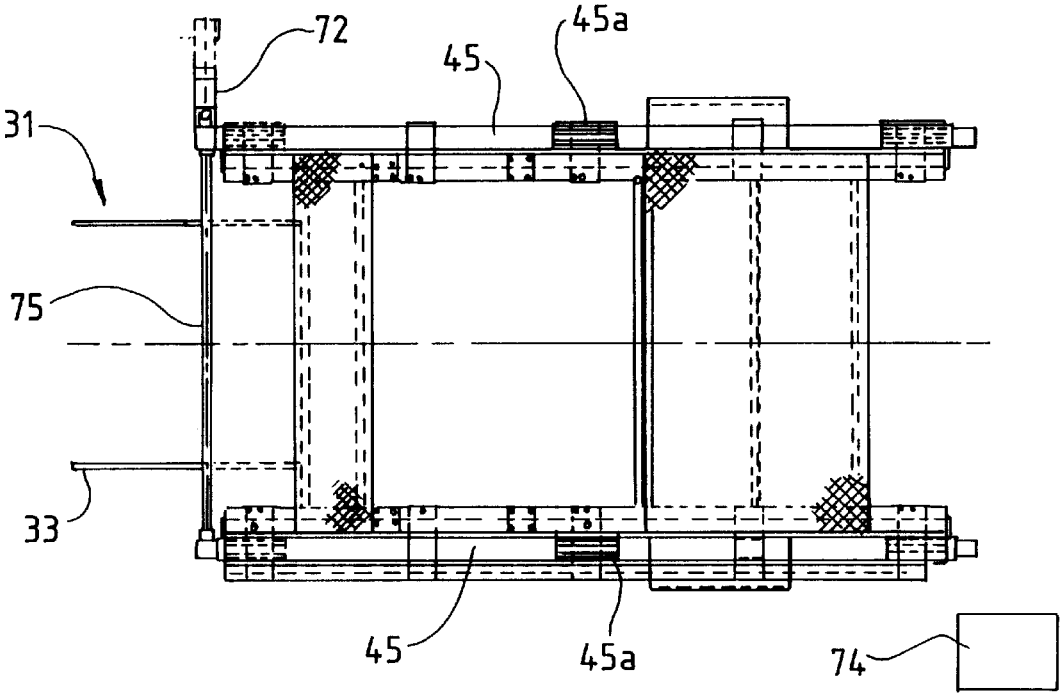
FIG. 4 is a top plan view of the left hand robot of FIG. 1 without the vertical motion components.
Figure 5:
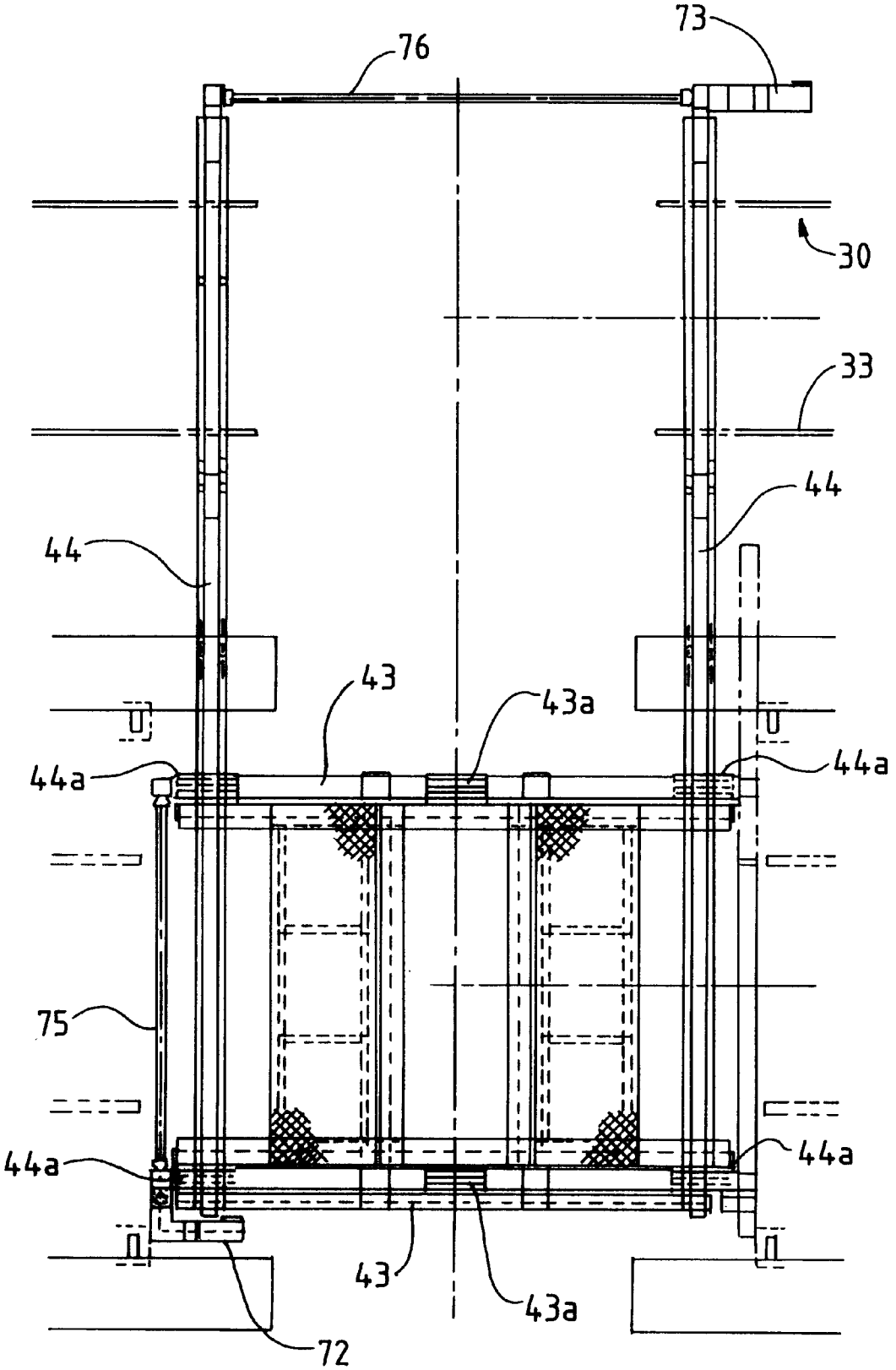
FIG. 5 is a top plan view of the right hand robot of FIG. 1 without the vertical motion components.

As mentioned previously, the anilox cylinder and plate cylinder can be staged in a cart 90 (FIGS. 1 and 2). Carts do, however, cause problems of their own. They need to be moved either by personnel or by some automated conveying type system. The support system for the external operations improves this method by providing stationary staging areas 30 and 31 for all the color deck components. The framework can be positioned directly behind the press (31 in FIG. 4) or behind and laterally offset from the press (30 in FIG. 5).

The framework 33 simulates the positions of the components within the press. There are cradles for the plate cylinder journals and supports for the carriage, which also contains the anilox roll and other components of the ink system. An empty area is required in the framework so that the robot has a place to transport the initial components from the press. With the staging framework, the robot can simply move components from the press directly to the clean-up/make ready area. There is no need for middleman devices such as roll carts to transport them to this area.

An alternate embodiment does require roll carts for the changeover process. This method eliminates the space for the plate cylinders 25 within the framework 33. The robot would still remove all the components in the press at one time. It would, however, separate the plate cylinder from the other components and bring the plate cylinder to a cart either before or after the carriage is deposited in the framework. The time required to accomplish this detour should not comprise the fifteen minute or less changeover goal. It does, however, shorten the make-ready time and reduces the number of times the plate cylinders need to be handled.

After the robot has completed an exchange and the used components are situated within the support system framework 33, clean-up and make ready tasks can commence. The first task is clean-up. Doctor holders can be cleaned manually, by some automatic wash-up system, or by exchanging them with clean holders. Remember, the press is running, and clean-up at this time does not equate to down time. It does, however, still need to be done quickly enough to accommodate the next changeover. The automatic wash-up system is the quickest way to complete this task. After the system is activated, personnel can concentrate their efforts on other clean-up/make ready tasks.

Assuming the automatic wash-up system is being used and the plate cylinders are not separated, the operator can begin staging the plate cylinders for the next run. The plate cylinders for the next job are transported on carts from the plate room to the staging framework. The robot which was used for the primary exchange is used once again. This time it is making exchanges from the framework to and from the plate cylinder cart. The wash-up system continues its sequence while the plate cylinder exchanges are made.

After the plate cylinders are staged for the next job and clean-up has been completed, the next step in the make-ready process is the exchange of anilox rolls. Again, the robot is utilized to accomplish this task. Roll carts containing the desired anilox rolls are brought into position and the exchange takes place.

Doctor holders can now be fitted with new blades and seals. The ink for the next job is brought into place. The final step of inking up will not occur until some predetermined time prior to changeover. This step is postponed as long as possible. The roll only needs to be inked up prior to the next changeover sequence. Accomplishing this task long before needed creates unnecessary VOC emissions, assuming solvent based inks are being used. However, time should be allotted to make ink or doctor setting modifications, if necessary.

The staging framework will be equipped with a conventional Sunday drive system which will provide for the anilox roll rotation necessary for ink-up purposes. When the time arrives for ink-up, this system is activated. Color swatch samples can now be taken. The make-ready personnel can make whatever ink and setting changes are required to achieve the desired printing parameters. These former internal changeover activities are now conducted as external tasks. The staging framework 33 would also include the motor required for the ink pump. The carriage 27 previously described would contain the pump heads. Like the framework, the press would have the motor for the ink pump permanently mounted on it. This design eliminates the need to carry the pump motors along with the carriage during exchanges.

The complete system, including carriage, robot, and support system is compact. Because of this, the system can easily be incorporated within a VOC capture type enclosure, if desired. The enclosure would surround the press and the staging framework. Doors for personal and cart access would be provided. The actual clean-up and roll exchange functions would be performed with the doors closes. This is done not only to reduce VOC emissions, but to also provide for safety. An operator control panel is located as the back of the staging framework and outside of the enclosure. This control panel would operate the wash-up system and provide the interface for robot roll exchange sequences. Windows within the capture enclosure permit personnel to view robot moves.

No other wide web press design provides for the changeover times required with today's short run printing environment. The quick change press system described herein provides the means for the printer to significantly reduce downtime and produce more printed product. This system does not sacrifice size or print quality to achieve changeover time. The design and methods are based upon the previously described criteria:

1. The process is automated rather than operator paced.
2. All clean-up and preparation work is done away from the press while the press is running.
3. Location of the print cylinder and anilox roll are precisely located in the press by the use of bearing caps which are permanently mounted to the press section.
4. The design is versatile. It allows for the removal of single components or the complete system with the use of the three point "pick and choose" system.

The robot can also be used to move components from multiple color deck locations on the press to multiple staging locations. For example, the robot can pick up the plate cylinder from one color deck on the press and the anilox roll from another color deck. The robot can then move the plate cylinder to one staging location and the anilox roll to another staging location. Conversely, the robot can move components from multiple staging locations to multiple color deck locations.

Although the robot has been described in conjunction with a flexographic press, it will be understood that the robot can be used with other types of presses.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. A robotic apparatus for a press having a pair of rolls, each of the rolls having first and second ends, comprising a first lift assembly adjacent the first end of the rolls, a second lift assembly adjacent the second end of the rolls, each of the lift assemblies including a frame and a pick-up carriage mounted on the frame for vertical movement, each pick-up carriage including a pair of lifting devices and means for extending and retracting each lifting device, means for raising and lowering the pick-up carriage on the frame, whereby lifting devices which are extended can engage the end of a roll and lifting devices which are retracted do not engage the end of a roll, and means for moving the lift assemblies in a first horizontal direction.

2. The apparatus of claim 1 including a pair of support frames having a plurality of staging positions for supporting sets of first and second rolls, each of the lift assemblies being movable in said first horizontal direction to a position adjacent one of the support frames.

3. The apparatus of claim 1 including means for moving the lift assemblies in a second horizontal direction.

4. The apparatus of claim 2 in which the support frame includes a plurality of staging positions for supporting ink carriages and each of the pick-up carriages includes a third lifting device for engaging an ink carriage.

5. The apparatus of claim 1 in which said extending and retracting means comprises a pneumatic cylinder for each lifting device whereby each lifting device can be extended and retracted independently.

6. A robotic apparatus for a printing press having a plurality of printing decks, each of the printing decks including a plate cylinder and a carriage assembly, each carriage assembly including a carriage and an anilox roll removably mounted on the carriage, each of the plate cylinder, carriage, and anilox roll having first and second ends, comprising:

a first lift assembly adjacent the first ends of the plate cylinder, carriage, and anilox rolls, a second lift assembly adjacent the second ends of the plate cylinder, carriage, and anilox roll, each lift assembly including a frame and a pick-up carriage mounted on the frame for vertical movement and means for raising and lowering the pick-up carriage on the frame, each pick-up carriage including a first lifting cup adapted to engage an end of a plate cylinder, a second lifting cup adapted to engage an end of an anilox roll, and a third lifting cup adapted to engage an end of a carriage assembly, and means for extending and retracting each of the lifting cups independently whereby the lifting cups can lift all three of the plate cylinder, anilox roll and carriage assembly or can lift the anilox roll and the carriage assembly and not the plate cylinder or can lift either the plate cylinder or the anilox roll.

7. The apparatus of claim 6 in which said extending and retracting means for each lifting cup comprises a pneumatic cylinder.

8. A method of preparing a flexographic press for a new printing run, the flexographic press including a plurality of color decks, each of the color decks including a plate cylinder and a carriage assembly, each carriage assembly including an ink carriage and an anilox roll removably mounted on the ink carriage, comprising the steps of:

mounting plate cylinders and carriage assemblies for a new printing run in a staging area, preparing the plate cylinders and the carriage assemblies in the staging area for the new printing run while the press is running, when the press is stopped, moving the plate cylinder and the carriage assembly from at least one of the color decks to the staging area, and moving a plate cylinder and a carriage assembly from the staging area to said at least one color deck.

9. The method of claim 8 including the step of mounting the plate cylinders and the carriage assemblies for the new printing run on a pair of support frames in the staging area.

10. The method of claim 8 in which the staging area includes a plurality of locations for plate cylinders and for carriage assemblies, and moving the plate cylinder from one of the color decks to one of said locations and moving the carriage assemblies from said one color deck to another of said locations.

11. The method of claim 8 including the step of removing the anilox roll from one of the carriage assemblies on the press, moving said anilox roll to the staging area, and moving an anilox roll from the staging area to said one carriage assembly.

12. A carriage assembly for a color deck of a flexographic press comprising:

a frame, means for mounting the frame on a flexographic press, an anilox roll removably mounted on the frame, and an ink container mounted on the frame for supplying ink to the anilox roll.

13. The carriage assembly of claim 12 in which the anilox roll includes a pair of axially extending journals and the mounting means comprises a pair of shafts on the frame which extend parallel to said journals.

14. The carriage assembly of claim 13 including a pair of journal caps on the frame for removably supporting the journals of the anilox roll.

* * * * *